United States Patent [19]

Deglise

[11] Patent Number: 4,798,039

[45] Date of Patent: Jan. 17, 1989

[54] PROCESS AND APPARATUS FOR FILLING CONTAINERS UNDER VACUUM

[75] Inventor: René Deglise, Pully, Switzerland

[73] Assignee: Ipatec S.A., Pully, Switzerland

[21] Appl. No.: 96,020

[22] PCT Filed: Dec. 5, 1986

[86] PCT No.: PCT/FR86/00422

§ 371 Date: Aug. 3, 1987

§ 102(e) Date: Aug. 3, 1987

[87] PCT Pub. No.: WO87/03555

PCT Pub. Date: Jun. 18, 1987

[30] Foreign Application Priority Data

Dec. 5, 1985 [CH] Switzerland ..... 5181/85

[51] Int. Cl.[4] ..... B65B 31/06; B65B 1/32; B65B 3/28

[52] U.S. Cl. ..... 53/432; 53/434; 53/469; 53/502; 53/510; 53/512

[58] Field of Search ..... 53/434, 432, 469, 468, 53/479, 510, 512, 502, 267, 276, 373

[56] References Cited

U.S. PATENT DOCUMENTS

| | | | |
|---|---|---|---|
| 2,524,560 | 10/1950 | Cote . | |
| 2,694,515 | 11/1954 | Green . | |
| 2,839,093 | 6/1958 | McCarthy . | |
| 2,966,019 | 12/1960 | Grafingholt | 53/512 X |
| 3,323,277 | 6/1967 | Hellriegel | 53/512 |
| 3,323,280 | 6/1967 | Rausch | 53/276 X |
| 3,498,020 | 3/1970 | Eppenberger | 53/502 X |
| 3,910,009 | 10/1975 | Canfield | 53/512 |
| 4,074,507 | 2/1978 | Ruf et al. | 53/502 |
| 4,137,689 | 2/1979 | McClusky et al. | 53/502 |
| 4,201,027 | 5/1980 | Ilsemann . | |
| 4,235,067 | 11/1980 | Parsons | 53/502 |
| 4,407,108 | 10/1983 | Craig | 53/502 X |
| 4,418,512 | 12/1983 | Johnson | 53/512 X |
| 4,538,399 | 9/1985 | Müller | 53/512 |
| 4,580,393 | 4/1986 | Furukawa | 53/512 |
| 4,706,441 | 11/1987 | Chervalier | 53/512 |

FOREIGN PATENT DOCUMENTS

| | | |
|---|---|---|
| 1306288 | 9/1962 | France . |

*Primary Examiner*—Horace M. Culver

*Attorney, Agent, or Firm*—Young & Thompson

[57] ABSTRACT

Method and device for the vacuum filling of containers by using a continuous conveyor bringing the containers straight below two successive fixed stations. At one of the stations the filling of the containers is carried out, and at the other station a vacuum sealing of the containers is carried out.

27 Claims, 5 Drawing Sheets

PROCESS AND APPARATUS FOR FILLING CONTAINERS UNDER VACUUM

The present invention concerns vacuum packaging of containers which are intended in particular to receive powder or granular materials.

The advantages which are achieved by filling sealed rot-proof containers under vacuum for the storage and handling of materials in powder or granular form are known.

A first advantage of packaging under vacuum is to permit all materials to be stored outside, with bad weather having no effect on the state of the materials which are packaged in that way.

A second advantage is the ease of handling of the containers to which the pressure of the air imparts a degree of rigidity which is largely sufficient to permit them to withstand the shocks and impacts which are inherent in handling operations carried out without particular precautions being taken.

A third advantage is good conservation of foodstuff and articles considered to be perishable, the vacuum preventing any oxidation, chemical reaction, hatching of insect eggs, mould and mildew or other disadvantages which are conventionally involved in the storage of perishable articles.

The recognised advantages of vacuum packaging of materials in powder or granular form are in practice of an economic significance such as to justify the use of expensive packaging equipment, in particular when containers of substantial dimensions are involved.

Those known apparatuses are conventionally formed by means for pouring the materials into the containers and means for sealing the containers, which are disposed in a vacuum chamber.

The corresponding processes involve opening the vacuum chamber, closing it, carrying out the different operations including producing the vacuum in the chamber, restoring the air therein and opening the chamber, and finally extraction of the containers.

That involves a number of disadvantages:

A vacuum chamber must contain the whole of the means for filling and sealing the containers.

The feed of materials to the filling means within the chamber is a complicated aspect and requires the use of expensive equipment.

A single container can be filled and packaged simultaneously in a vacuum chamber.

In order to package a plurality of containers simultaneously, it is necessary to use an equal number of vacuum chambers, implying installations involving a substantial level of cost.

An object of the present invention is an apparatus for permitting the simultaneous packaging of a plurality of containers, while retaining simplicity in the means used, which considerably reduces its cost in comparison with the prior-art apparatuses.

Another object of the invention is a process for vacuum filling containers using an apparatus according to the invention.

More precisely, an apparatus for filling containers under vacuum with materials in powder or granular form, according to the invention, comprising in combination:

conveyor means for the materials;

means for weighing the materials;

means for pouring the materials into containers;

means for putting the containers under vacuum; and means for sealing the containers;

referred to as fixed means, is characterized in that it uses a turntable which rotates discretely and intermittently through an angle of 360°/N, N being a number of support means suitable for each receiving a container, N being at least equal to three, said support means being fixed with respect to the turntable and distributed at the periphery thereof at an angular spacing of 360°/N, and that said fixed means are distributed at two fixed stations disposed at an angular spacing of 360°/N from each other.

In addition, the discrete rotary movement through 360°/N of the turntable takes place at regular intervals of time, while interposed stoppage periods may also be regular.

In accordance with another aspect of the invention the two fixed stations are respectively disposed in vertical alignment with two of the support means for each stopped position of the turntable.

More precisely the material conveyor means, the material weighing means, and the means for pouring the materials into the containers are combined at a first fixed station in vertical alignment with a stop position of a support means, and the means for putting containers under vacuum and the means for sealing containers are combined at a second fixed station disposed in vertical alignment with a support means for a container in one of the stop positions thereof which is immediately following its stop position in vertical alignment with the first fixed station.

Advantageously the sealing means comprise a pair of plates forming jaws adapted to grip the neck of a container, one of said jaws being coupled to a vibration generator; the vibrations may be either high-frequency vibrations for ultrasonic welding or low-frequency vibrations for welding by friction.

Preferably an apparatus according to the invention is also characterised in that the support means are shells or casings which match the shape of the containers and which are open in their upper portion and which are capable of opening along a meridian plane into two portions which are substantially symmetrical with respect to said plane, one portion being fixed to the turntable and another being movable in rotation by way of hinge means defining a substantially horizontal axis of rotation.

Preferably, the support means are provided at their upper end with a rim forming a plate capable of cooperating with a vacuum hood capable of performing a vertical movement in a sealed manner when it is in the lowest portion in its movement.

In accordance with a preferred embodiment the containers are of a hexagonal cross-section and are provided with a neck in their upper portion forming a single opening.

The invention also concerns a process for filling containers under vacuum using an apparatus as generally described hereinbefore, the process being characterised in that it comprises the succession of the following operations:

an empty container is disposed in a support means in an open position, being held by way of suitable means, the support means is closed, the turntable is rotated to move the support means into vertical alignment with the first fixed station, the pouring means are lowered to move the lower portion thereof into the neck of the container, a valve with which the pouring means are equipped is opened in order to pour the materials into the container, suction means are set in operation, the pouring means are lifted off, the turntable is rotated to move the support means into vertical alignment with the second fixed station, the vacuum hood is lowered so that it comes into a position of co-operating with the surface of the plate of the support means, a vacuum is produced in the space which is confined in that way, the neck of the container is crushed by moving the sealing means towards each other and the walls of said neck are welded so as to seal it, the vacuum hood is vented, the vacuum hood is lifted off, the turntable is rotated through 360°/N and the support means is opened, the sealed container is removed, and the turntable is rotated to move the support means to the following station.

In accordance with a preferred embodiment of the invention the operations which consist of disposing the container in a support means and removing the container are effected at two successive different stations.

The features and advantages of the present invention will be apparent from the following description given by way of example of an embodiment of the invention with reference to the accompanying drawings in which.

Figure 3:
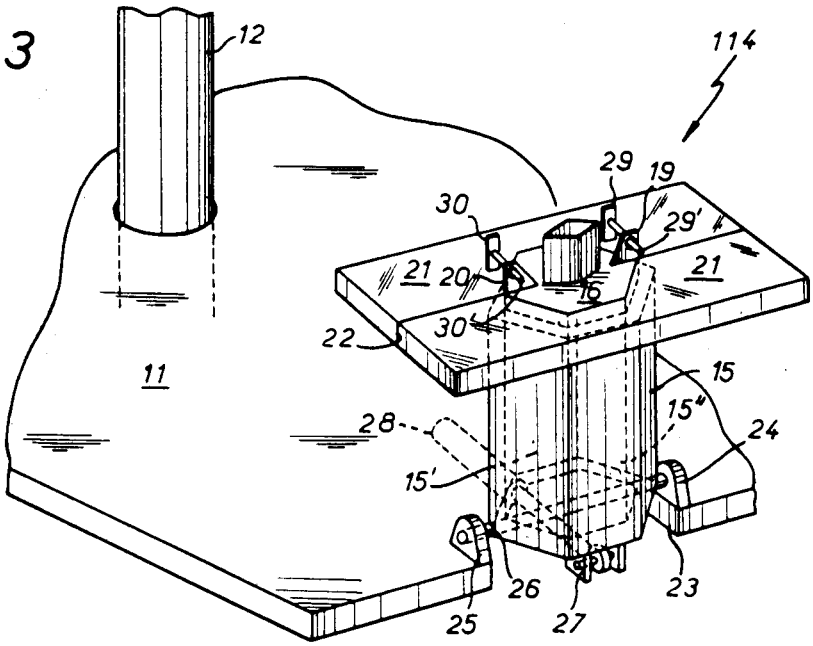
Figure 3A:
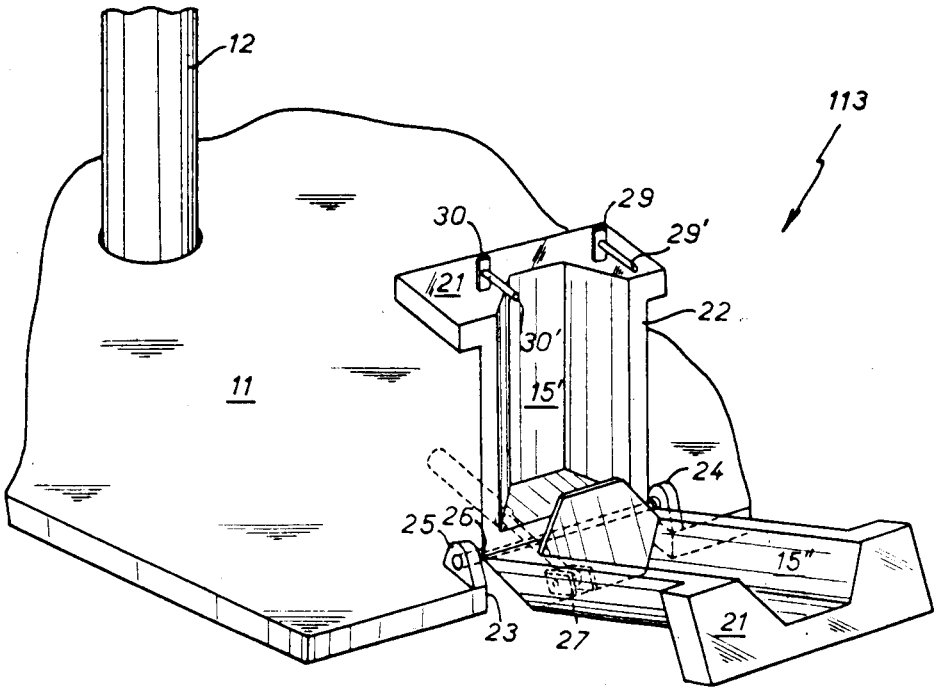
Figure 4:
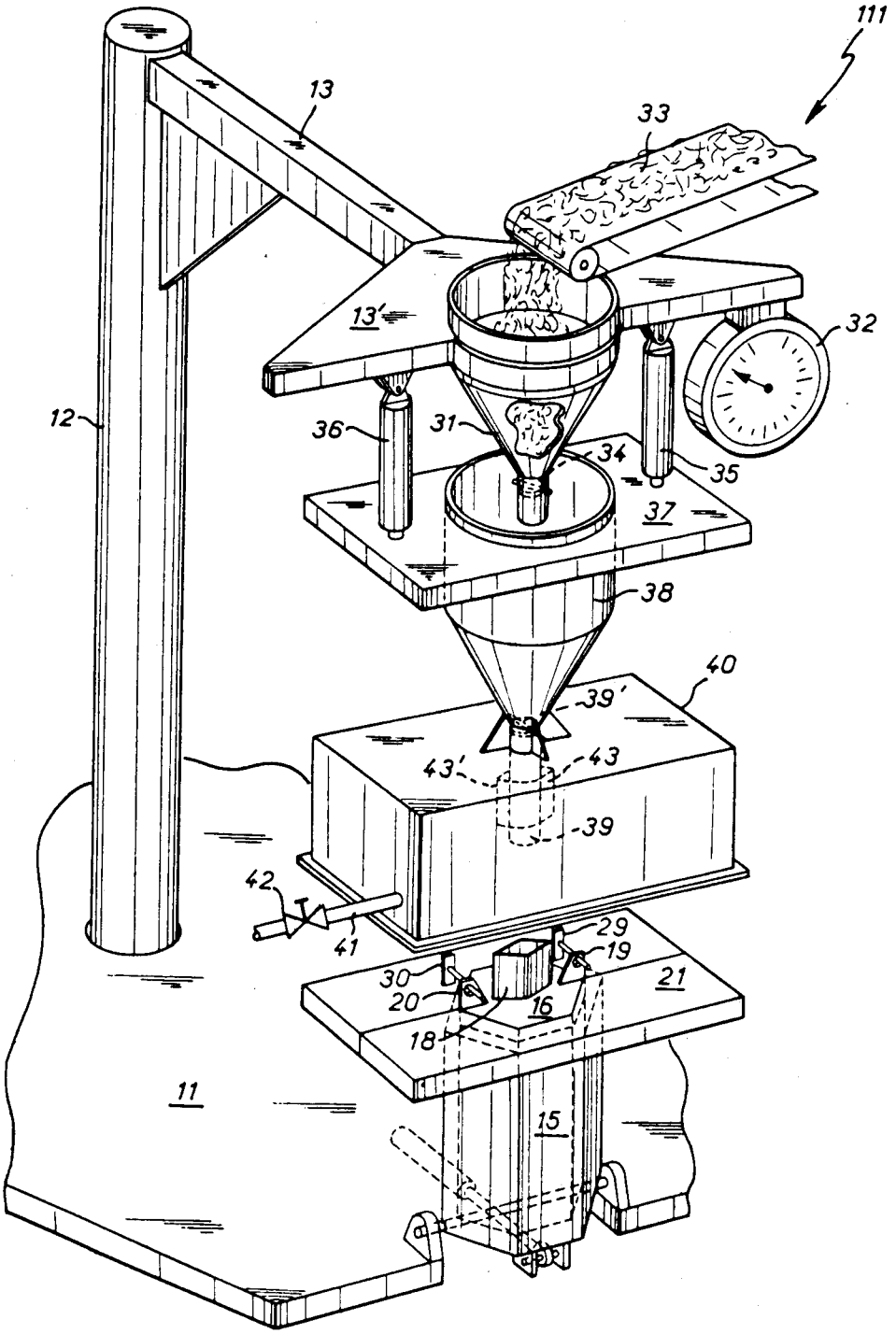
Figure 4A:
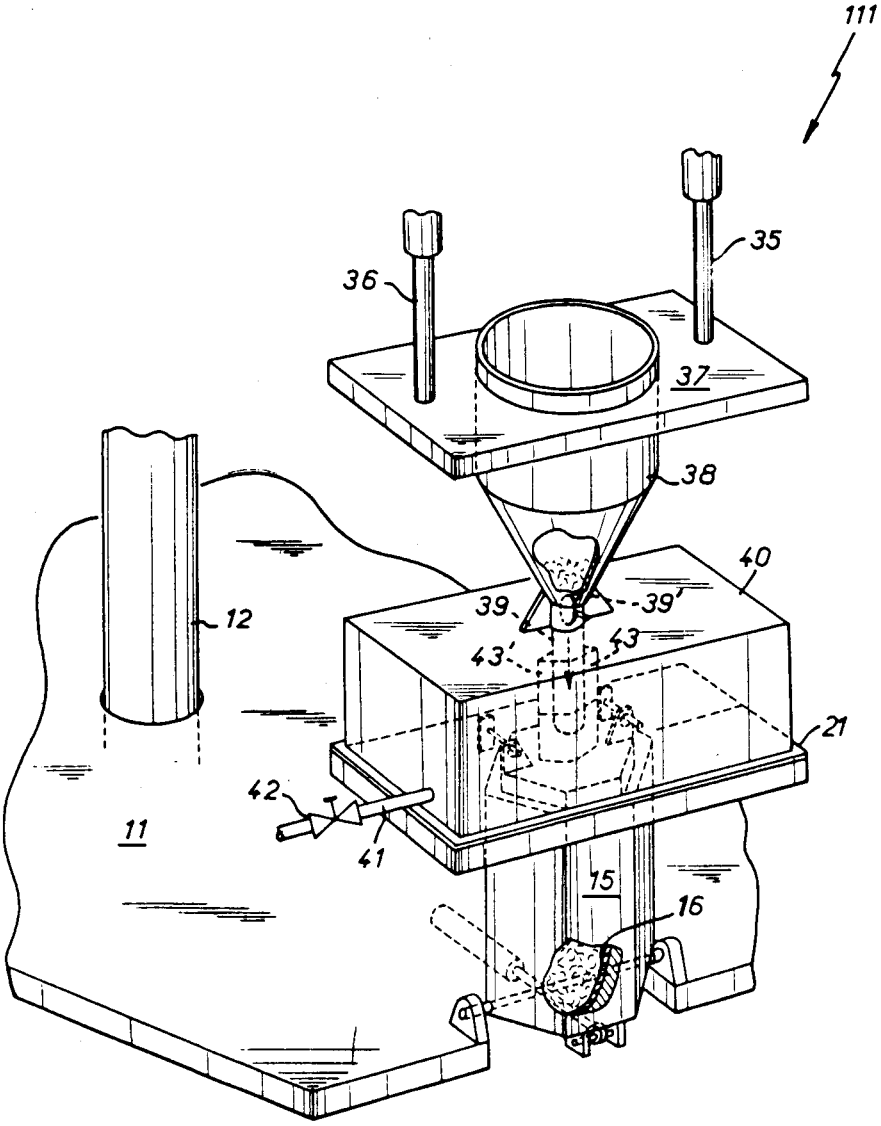
Figure 5:
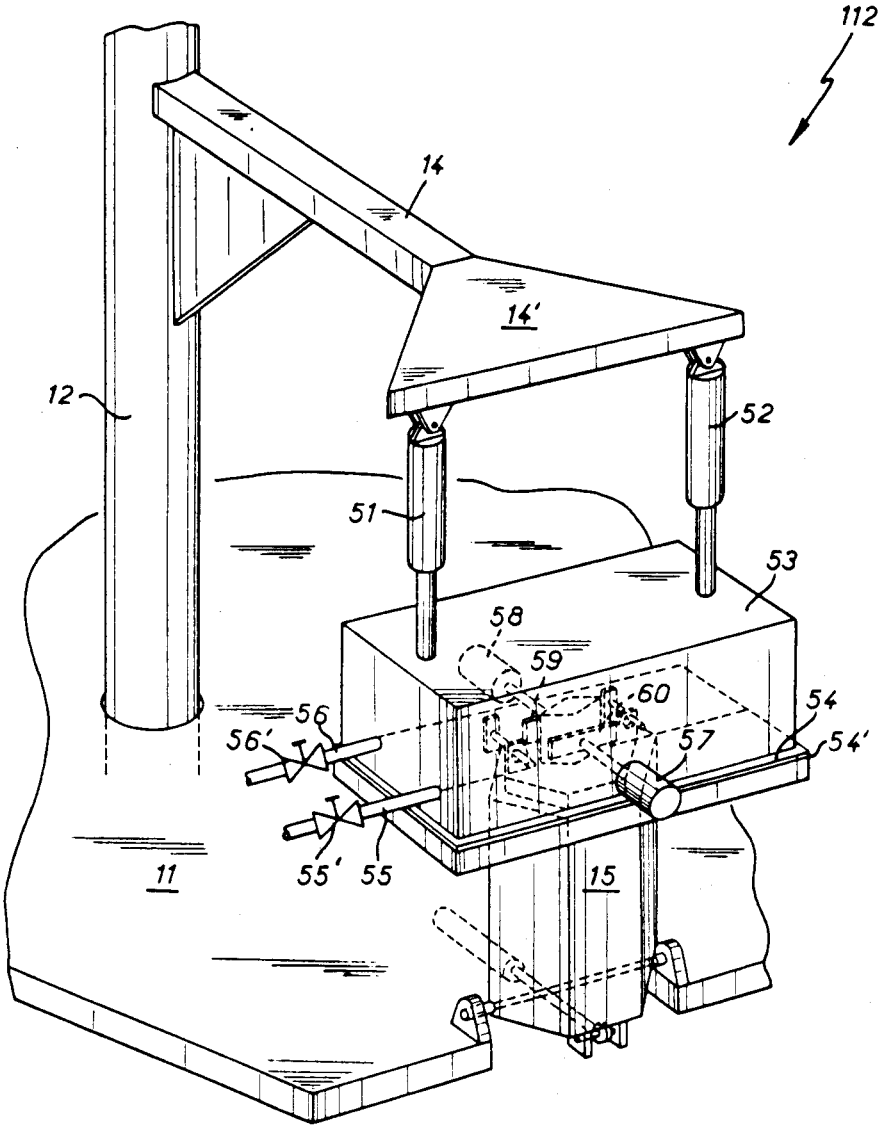

FIG. 3 is a perspective view of part of an apparatus according to the invention in a defined position, FIG. 3A corresponds to FIG. 3, showing a different position of the apparatus according to the invention, FIG. 4 is a perspective view of another part of an apparatus according to the invention in a defined position, FIG. 4A is a view corresponding to FIG. 4, in simplified form, in another position, and FIG. 5 is a perspective view of another part of an apparatus according to the invention.

Figure 1:
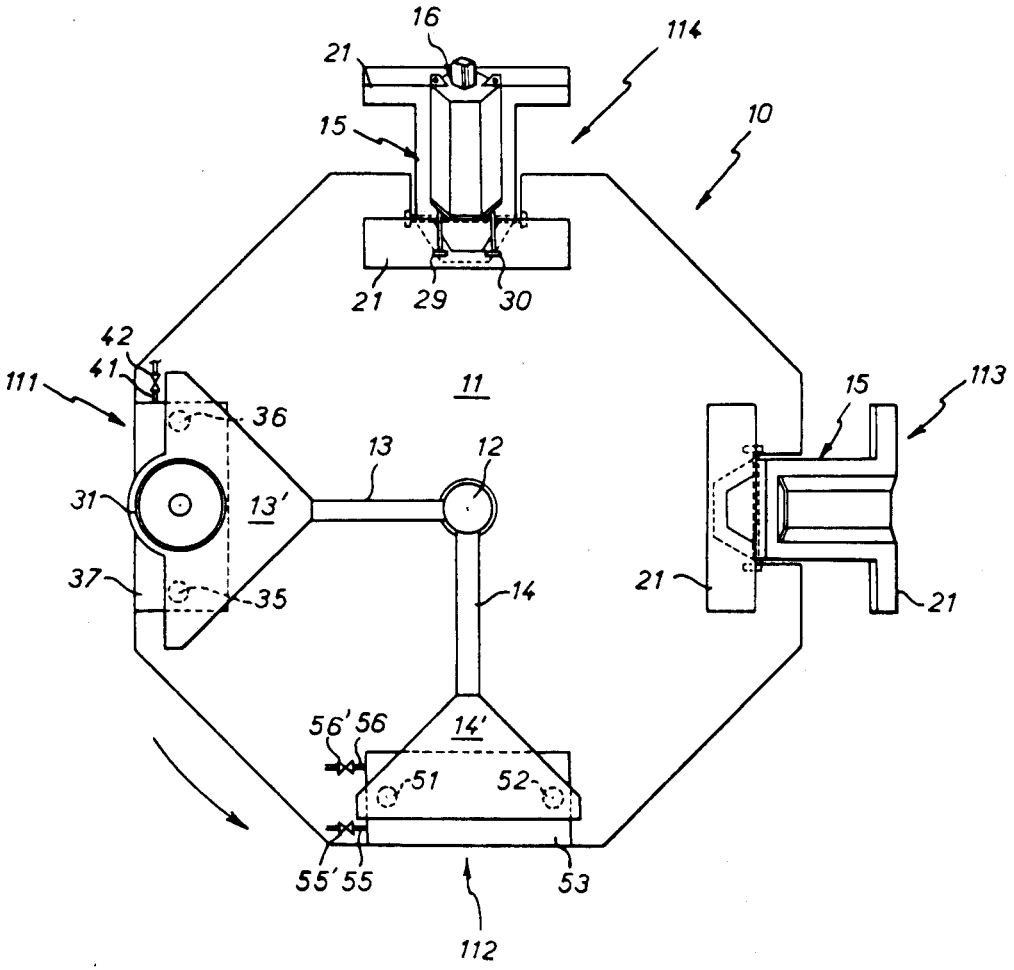
FIG. 1 is a diagrammatic plan view of an apparatus according to the invention.

In greater detail, FIG. 1 diagrammatically shows a turntable or carrousel 10 comprising an octagonal base 11 which is rotationally movable about a fixed shaft 12 supporting two arms 13 and 14 forming a gantry, projecting normally with respect to the axis 12 and being orthogonal relative to each other.

In per se known manner, the base 11 may be intermittently driven in rotation by a motor (not shown) disposed beneath the base 11. In FIG. 1 the direction of rotating of the turntable is the trigonometric direction, as indicated by the arrow.

The two arms 13 and 14 serve in the described embodiment as supports for elements forming two fixed stations 111 and 112 respectively.

In other embodiments, the fixed stations 111 and 112 may be supported by one or more different gantries.

Two other fixed stations 1113 and 114 which are not provided with gantries are respectively disposed at 90° and 180° relative to the station 112.

In practice they are defined just by their angular positions.

Disposed at each station, when the turntable is stationary, is a shell or case 15 which is loaded at the station 113 with a container 16. The case 15 is of hexagonal cross-section.

In practice the cases which are to be found at the stations 111 and 112 are also provided with containers 16 which cannot be seen in FIG. 1.

Figure 2:
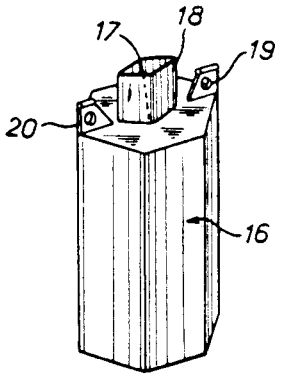
FIG. 2 is a perspective view of a container according to the invention.

FIG. 2 shows a perspective view of a container 16. It is a pocket of hexagonal cross-section which is substantially constant over its height, being closed at the two ends in a plane normal to its general axis. A face which is referred to as the top face is provided with a slender fusiform opening 17 having two orthogonal axes of symmetry. A neck 18 prolongs the opening 17, with a cross-section corresponding thereto.

Two lugs or ears 19 and 20 are disposed on respective sides of the neck at 180° in alignment with the axis of symmetry of the opening 17 corresponding to its greatest width. The lugs 19 and 20 have apertures passing therethrough and form rings.

In the described embodiment the container 16 is made of a semi-rigid material, for example polyethylene. Such a container is advantageously produced by extrusion blowing.

FIG. 3 shows a case 15 which is loaded with a container 16 and which is closed therearound.

The case 15 is of substantially hexagonal cross-section on its outside and on its inside, and matches the shape of the container 16.

The upper portion of the case 15 is open, thus permitting the neck 18 of the container and the lugs 19 and 20 to pass therethrough.

The upper portion is also bordered by a rectangular plate 21 extending normal to the general axis of the case 15.

The case 15 is divided into two portions 15' and 15'', as shown in FIG. 3A which illustrates it in the opened position.

More precisely the case 15 is formed by two half-cases 15' and 15'' which are substantially symmetrical and which meet in the closed position (FIG. 3) at a meridian joining plane 22.

The portion 15' is preferably removably fixed to the base 11 and is positioned by way of the bottom portion thereof in a semi-hexagonal base of a recess 23 provided in the base 11 for receiving it.

It is thus possible rapidly to replace the cases 15 by others of different shapes and/or capacity.

In practice four recesses 23 (FIG. 1) are disposed in orthogonal angular positional relationship at the periphery of the base 11 and thus receive four cases 15.

Each recess 23 is formed by a cut-out portion having a semi-hexagonal bottom radially inwardly of the base 11, being extended radially perpendicularly to the corresponding edge of the base 11 towards the periphery. The edges, which are referred to as radial edges, of the recess 23 have disposed above them two bearings 24 and 25 carrying a shaft or spindle 26 extending from one edge of the cut-out portion to the other and in parallel relationship to the corresponding edge of the base 11 and the meridian plane 22.

The portion 15'' of the case 15 is fixed by way of the bottom portion thereof to the shaft or spindle 26. The portion 15'' can thus pivot with the shaft or spindle 26, permitting the case 15 to open.

In the described embodiment, the portion 15" comprises a hexagonal bottom plate of an area corresponding to the cross-section of the case and pivoting therewith.

In practice the portion 15" can be inclined to an angle of about 100° with respect to the plane 22.

In its bottom portion the movable portion 15" of the case 15 comprises a pivotal anchorage point 27 to which there is connected a jack 28 (shown in broken lines) which is fixed by way of its other end to the base 11. The jack 28 controls the inclination of the portion 15".

Disposed in projection relationship on the top of the plate 21 and more precisely the part thereof which borders the fixed portion 15' of the case 15 are two substantially vertical movable uprights 29 and 30 (in practice, when the case 15 is fixed to the base 11, the general orientation of the axis thereof is substantially vertical, the base 11 being substantially horizontal). Each upright 29, 30 is provided with a horizontally projecting finger 29' and 30' respectively. More precisely the fingers 29' and 30' are parallel to each other and normal to the plane 22.

The uprights 29 and 30 are movable in the direction of their general orientation and are actuated for displacement towards an upper position by closure of the case 15 and towards a lower position by the opening thereof. Means for controlling the displacement thereof (not shown) are provided.

The fingers 29' and 30' serve to support the container 16, as illustrated in FIG. 3: the rings 19 and 20 are threaded on to the fingers 29' and 30' respectively and the container 16 is thus supported thereby.

FIG. 4 shows a perspective view of the station 111 or the first station.

The arm 13 which projects radially from the shaft terminates radially outwardly with a plate 13' which is substantially triangular, with the base thereof being perpendicular to the arm 113.

A circular opening is provided in the base of the plate 13', a part of which is formed by a radially projecting rim portion of half-ring configuration on the plate 13'. The opening receives, by way of suitable suspension means (not shown) the plate or pan of a weighing device formed by a hopper referred to as the receiving hopper 31. The hopper 31 is coupled to a weighing dial 32 suspended below the plate 13', laterally offset with respect to the hopper 31.

An endless conveyor 33 supplies materials to be poured by gravity into the receiving hopper 31.

The hopper 31 which is of a substantially funnel-shaped configuration is provided in its lower part with a blocking valve 34. Two jacks 35 and 36 suspend an intermediate plate 37 having an opening for receiving an intermediate hopper 38 disposed in vertical alignment below the receiving hopper 31.

The intermediate hopper 38 is formed by a generally cylindrical upper portion which is extended by a substantially funnel-shaped lower portion.

An anti-dust skirt 40 in the form of a right-angled parallelipiped which is open at its bottom face is fixed with respect to the lower portion of the intermediate hopper 38, which communicates with the interior thereof.

The lower part, referred to as the bottom part, of the intermediate hopper 38 terminates with a substantially cylindrical conduit 39 projecting into the interior of the skirt 40.

The conduit 39 is bordered by two evacuation ducts 43 and 43' which are in diametrally opposite relationship and which are of substantially triangular cross-section.

Those two ducts which are of general orientation with respect to the conduit of the lower part extend over only a part of the height thereof, which is within the skirt 40.

In the described embodiment, the two ducts 43 and 43' are angle members which are fixed by way of their two free edges to the outside wall surface of the conduit 39. The dimensions and the arrangement of the ducts 43 and 43' is such that the conduit 39 is capable of passing into the neck 17 of a container 16.

One side of the skirt 40 is provided with a conduit 41 provided with a valve refered to as the suction valve 42 which is connected to a suction device (not shown).

On its lower perimeter the skirt 40 comprises a rim portion provided with a seal capable of co-operating with the plate 21 which is disposed in vertical alignment therewith. The plate 31 and the skirt 40 are preferably of substantially the same surface area in plan.

FIG. 4A shows the station 111 in a different position from that illustrated in FIG. 4. The assembly formed by the intermediate plate 37, the intermediate hopper 38 and the skirt 40 is in the lower position which is determined by extension of the jacks 35 and 36. In that position the lower edge of the skirt 40 matches the edge of the plate 21 and the conduit 39 of the hopper 38 with the two ducts 43 and 43' passes into the neck 17 of the container 16.

The valve 39' is shown in the open position, thus permitting communication of the intermediate hopper with the interior of the container 16. At the same time the suction valve 42 is open.

FIG. 5 is a general perspective view of the fixed station 112. An arm 14 is fixed to the shaft 12 in radially projecting configuration and in orthogonal relationship to the axis of the shaft 12. The arm 14 is similar to the arm 13 and is orthogonal in plan with respect thereto, as mentioned above. The shaft 14 is terminated by a triangular platform 14' which is similar in shape to the platform 13'.

Unlike the platform 13', the platform 14' does not have any recess, serving simply as an anchorage point for two substantially vertical jacks 51 and 52 connected to a vacuum hood or cap 53.

In FIG. 5, the two jacks and the vacuum hood are shown in the lower position and are capable of a vertical movement which is at least equal to the height of the neck 18 of the container 16.

The substantially parallelipipedic vacuum hood 53 which is open at a lower face preferably has rounded internal corners. Its size in plan is such that it is capable of fitting to the surface of the plate 21 of a case 15 which is in vertical alignment therewith, in such a way as to be sealed with respect thereto. For that purpose the lower periphery of the hood 53 is provided with a rim portion 54 which is bordered with a sealing joint 54'.

Two conduits 55 and 56 which are respectively provided for producing a vacuum in and venting the interior of the hood 53 are connected to the interior thereof in conventional manner. The conduit 55 which is controlled by a valve 55' is connected to a vacuum pump while the conduit 56 which is controlled by a valve 56' communicates with the ambient air.

Two jacks 57 and 58 which are aligned in mutually facing relationship comprise a fixed casing in projecting relationship on the outside of the vacuum hood 53 and a piston which is movable in the interior of the hood. The general orientation of the jacks 57 and 58 is parallel to the shaft 14 and they are aligned with the axis of symmetry corresponding to the smallest dimension in plan of the neck of the container 16.

The jacks 57 and 58 are each terminated with a plete 59 and 60 respectively. The plates 59 and 60 are substantially rectangular and are normal to the axis of the jacks, the plates being parallel to each other.

One of the plates, for example the plate 59, is provided with an ultrasonic transducer (generally referred to as a 'sonotrode'), while the other plate, being the plate 60 in this case, is a simple wave reflection plate (generally referred to as the 'anvil').

More precisely, the respective positions of the plates 59 and 60 are such that, when the hood 59 is in its lower position, the plates are disposed symmetrically on respective sides of the neck 18 of the container 16 which is held in the case 15.

Those plates are parallel to the axis of symmetry corresponding to the greatest width in plan of the neck 18, the width of the plates being slightly greater than said width of the neck.

In practice, the plates form welding members which can be brought towards each other by operation of the jacks 57 and 58 in order to crush the neck 18.

The fixed stations 113 and 114 (FIG. 1) do not include any particular arrangement in the described embodiment.

The station 113 which is referred to as the unloading or discharging station is a location at which the case 15 is opened to an angle of about 100°. In that way the movable portion 15'' of the case is slightly inclined towards the outside of the turntable.

The station 114 which is referred to as the loading or charging station is a location at which the case 15 is opened to an angle of 45° for example in order to enhance accessibility of the interior thereof for the empty containers.

The mode of operation of an apparatus according to the invention will now be described, at the same time as the corresponding process for filling containers under vacuum.

In the above-described embodiment, the turntable 10 rotates intermittently through 90° about its axis. Thus, each rotary movement entrains the four cases towards the station following that at which the cases are initially disposed. Between two rotary movements, the stop time is adjusted to be equal to the time of the longest of the operations caried out at one of the four stations 111 to 114. That stop time may be predetermined or it may be controlled by an operator.

In practice, the succession of operations for each container is as follows:

an empty container 16 is disposed in a case 15 at the loading station 114, with the case being open;

the case 15 is closed again. The fingers 29' and 30' are introduced into the lugs 19 and 20 and support the upper part of the container 16. At the same time the turntable is rotated through 90°. Those operations are advantageously simultaneous, the departure from the station 114 actuating the jack 28 determining the position of the movable portion 15'' of the case 15.

Closure of the case 15, by way of suitable means (not shown), causes the lifting movement of the fingers 29 and 30, whereby the neck 18 of the container 16 is moved into a position suitable for the filling thereof, the top surface thereof (except for the neck and the ring members) then being at the level of the plate 21;

when the case 15 and the container 166 have reached the station 111 (FIG. 4), the pouring means, that is to say the intermediate hopper 38 and the anti-dust skirt 40 are lowered.

The lower edge of the skirt 40 meets the plate 21 while the base conduit 39 passes into the neck 18 of the container (FIG. 4A);

the valve 42 is opened and, by way of the conduit 41, the dust or other undesirable bodies in the skirt 40 are sucked out.

At the same time the valve 39' is opened, which permits the material contained in the intermediate hopper 38 to be poured out, following an operation which takes place independently from that of the turntable and which will be described hereinafter, into the container 16.

The ducts 43 and 43' make it possible to avoid the formation of air pockets which are enclosed by material in the container 16, in particular by virtue of the slight depression produced by the suction operation;

when the whole of the materials contained in the intermediate hopper 38 has been poured into the container 16, the valve 42 is closed again, which interrupts the suction operation, and the pouring means are lifted off;

the valve 39 is closed again;

the turntable is again rotated through 90° to move the case and the filled container to the station 112 (FIG. 5);

the vacuum hood 53 is lowered, the seal 54' sealing same to the plate 21;

the valve 55' is opened, which establishes a communication between the conduit 55 and a vacuum pump (not shown), the vent valve 56' being closed.

Vacuum is then produced in the space confined in the hood 53 and the case 15;

once the desired level of vacuum has been achieved (for example between 200 and 250 Torrs) the valve 55' is closed, extension of the jacks 57 and 58 is initiated, which moves the plates 59 and 60 to a position of crushing the neck 18 over a part of the height thereof;

the emission of ultrasound by the transducer of the plate 59 is initiated, causing welding of the neck 18 in conventional manner;

the plates 59 and 60 are moved away and the vent valve 56' is opened;

the vacuum hood is lifted off; and the turntable is rotated through 90° and the case 15 is opened.

The effect of that is to move the fingers 29 and 30 into their lower position. The container 16 then rests on the bottom of the case 15. The effect of that is to free the rings 19 and 20 from any pulling stress. The container then has a tendency to take up an inclined position with the movable portion 15'' of the case 15 when the latter is opened, due to the action of the bottom plate which is fixed with respect to the portion 15''.

The case 15 is at the station 113 at which the movable portion 15'' of the case is opened at an angle which is slightly greater than 90°, for example 100°.

Thus the inside wall of the portion 15'' of the case constitutes a slightly inclined plane on which the container slides due to the simple effect of gravity, which moves it to discharge means, for example a conveyor.

A cycle then being concluded, the turntable is again rotated through 90° to begin a fresh cycle again.

It will of course be appreciated that all those operations are carried out during a cycle on the three other containers and cases, with a time shift corresponding to their respective positions.

As mentioned above, the intermediate hopper 38 is supplied with predetermined amounts of materials simultaneously and independently. More precisely a conveyor 33 (FIG. 4) carries the materials until they are tipped into the receiving hopper 31, the valve 34 being closed.

In practice the receiving hopper behaves like a weighing or tilting pan, the dial 32 being independent. When the weight of materials reaches a given threshold corresponding to the amount of material which is to be packaged in a container, a contact is closed, stopping the conveyor and at the same time opening the valve 34. The amount of material which is measured in that way is then tipped into the intermediate hopper 38.

Preferably, the apparatus includes a safety device for delaying opening of the valve 34 when the intermediate hopper 38 is in the down position.

The amount of material in the receiving hopper then remains constant until the intermediate hopper goes up again. When the weight of material contained in the receiving hopper 31 becomes zero, that is to say the hopper 31 is empty, another contact is closed, closing the valve 34 and starting the conveyor 33 moving again.

A fresh supply and weighing cycle then begins again.

In an alternative embodiment of the invention, the containers are provided with lugs 19 and 20 comprising flanges or shoulders in their upper part, permitting them to be seized by means of grippers. It is thus possible for the fingers 29 and 30 to be replaced by such grippers.

Likewise, different removal means may be provided at the station 113: grippers or hooks may seize the container by means of its lugs and remove it by suspending it.

The number of stations is denoted by N and in the embodiment described N is equal to four.

In a simplified embodiment of the invention N may be equal to three, with emptying and loading of the case being effected manually at the same station.

Besides the resulting simplification in the apparatus according to the invention, that embodiment has the advantage of reducing the size thereof. On the other hand the number of manual operations is increased as a result.

In another embodiment of the invention the intermediate hopper may be eliminated, with the receiving hopper directly tipping the materials into the container.

In an alternative embodiment, a fixed gantry which is external to the base of the turntable supports the different stations. Such an arrangement is particularly advantageous for substantial installations where the weight of the fixed stations would give rise to a problem in regard to construction, if it were supported in cantilever relationship.

Moreover, for sealing the neck 18 of the container 16, instead of the ultrasonic welding process referred to above, it may be preferred in certain uses to employ the procedure of welding by means of friction, which is also known; the neck to be sealed is then gripped between two jaws of which one is fixed while the other is operated with a vibration at low frequency (for example 300 Hz) with an amplitude of a few millimetres.

I claim:

1. In an apparatus for vacuum filling containers with pulverulent or granular materials, including weighing means for weighing the materials, conveying means for conveying pulverulent or granular materials to said weighing means, dispensing means for dispensing weighed materials from the weighing means to containers, vacuum means for applying vacuum to the containers containing the materials, and sealing means for sealing the vacuum filled containers; wherein the improvement comprises a turntable mounted for intermittent rotational movement relative to all the aforesaid means, said turntable having at its periphery a plurality of at least three support means for receiving respective ones of the containers, said support means being uniformly angularly spaced from one another, said conveying means, weighing means, dispensing means, vacuum means and sealing means being each arranged at one of two fixed stations proximate to the periphery of said turntable, said fixed stations having the same angular spacing between each other as the angular spacing between angularly adjacent ones of said support means.

2. Apparatus according to claim 1, wherein said turntable has regular dwell periods between intermittent rotational movements.

3. Apparatus according to claim 2, wherein said fixed stations are in general vertical alignment with two of said support means for each dwell position of said turntable.

4. Apparatus according to claim 1, wherein said conveying means, said weighing means and said dispensing means are arranged at a first one of said fixed stations.

5. Apparatus according to claim 4, wherein said weighing means are responsive to an accumulation of a predetermined weight of the materials for stopping said conveying means.

6. Apparatus according to claim 5, wherein said weighing means comprises a receiving hopper disposed in vertical alignment above said dispensing means, said weighing means controlling a valve responsive to the accumulation of the predetermined weight of materials, the valve being adapted to release the predetermined weight of accumulated materials from the weighing means into said dispensing means.

7. Apparatus according to claim 6, comprising means responsive to the discharge of the predetermined weight of the accumulated materials for closing said valve and for activating said conveying means.

8. Apparatus according to claim 4, wherein the containers have necks and said dispensing means comprises an intermediate hopper mounted for a predetermined substantially vertical movement in cooperation with the neck of the container at said first station.

9. Apparatus according to claim 8, wherein said intermediate hopper has a value at its lower end, said valve being adapted to be received inside the neck of the container at said first station.

10. Apparatus according to claim 9, wherein said intermediate hopper has an anti-dust skirt provided with suction means for producing negative pressure inside said skirt.

11. Apparatus according to claim 4, wherein said vacuum means and said sealing means are arranged at a second one of said fixed stations, said second fixed station being located downstream of said first fixed station relative to the direction of rotational movement of said turntable.

12. Apparatus according to claim 1, wherein said vacuum means and said sealing means are arranged at said second fixed station in vertical alignment with said container at said second station, said second station being located at one step of intermittent rotational movement downstream from said first station relative to said intermittent rotational movement of said turntable.

13. Apparatus according to claim 12, wherein said vacuum means is mounted for vertical movement into cooperation with said support means at said second fixed station.

14. Apparatus according to claim 13, wherein said vacuum means comprises a vacuum hood adapted to cooperate with said support means at said second fixed station so as to isolate the interior of the support means at said second station from the surroundings, said vacuum means further comprising a vacuum valve adapted to selectively connect the interior of said hood with a vacuum pump, and a vent valve for selectively venting the interior of said hood.

15. Apparatus according to claim 14, wherein said sealing means is disposed inside said hood.

16. Apparatus according to claim 12, wherein said sealing means comprises a pair of plates defining jaws adapted to grip the neck of the container at said second fixed station, one of said plates being coupled to a vibration generator.

17. Apparatus according to claim 1, wherein each of said support means comprises a case having an interior matching the configuration of said containers, each of said cases having two substantially symmetrical portions open at their upper ends and adapted to meet along a plane of symmetry of the case, one of said case portions being fixed to said turntable and the other of said case portions being pivotally mounted about a horizontal axis of rotation.

18. Apparatus according to claim 17, wherein said intermediate hopper has an anti-dust skirt provided with suction means for producing negative pressure inside said vacuum means, said vacuum means comprising a vacuum hood adapted to cooperate with said support means at said second fixed station so as to isolate the interior of the support means at said second station from the surroundings, said vacuum means further comprising a vacuum valve adapted to selectively connect the interior of said hood with a vacuum pump, and a vent valve for selectively venting the interior of said hood, said vacuum means being mounted for vertical movement into cooperation with said support means at said second fixed station, each of said support means including at an upper end a plate in sealing relation with said vacuum hood when said head is in its lowered position and in sealing relation with said anti-dust skirt when said skirt is in its lowered portion.

19. Apparatus according to claim 17, wherein said support means includes at least two parallel support fingers normal to said plane of symmetry, said support fingers being mounted for movement between a raised position to which they are moved during closure of said support means and a lowered position to which they are moved during opening of said support means.

20. Apparatus according to claim 17, wherein releasable fixing means releasably secures each of said support means to said turntable, said support means being interchangeable with other support means having an interior matching a container having a configuration different from that of the first-mentioned containers.

21. Apparatus according to claim 19, wherein said containers have lugs adapted to receive said fingers.

22. Apparatus according to claim 21, wherein said containers are of hexagonal cross section and have necks defining a single opening in said containers.

23. A method of vacuum filling containers with pulverulent or granular materials in an apparatus comprising first and second fixed stations, weighing means, said first station having conveying means for conveying pulverulent or granular materials to said weighing means for weighing the materials and dispensing means for dispensing the weighed materials from the weighing means to the containers, said second fixed station having vacuum means for applying vacuum to the containers containing the materials and sealing means for sealing the vacuum sealed containers, and a turntable mounted for intermittent rotational movement relative to said first and second fixed stations, the turntable having a plurality of at least three openable/closable support means for respective containers, the support means being uniformly angularly spaced from each other, said first and second fixed stations being arranged proximate to said turntable, the angular spacing between said fixed stations being the same as that between said support means, the method comprising the steps of:

placing an empty container in an open support means located at a loading station spaced upstream from said first fixed station relative to the direction of intermittent rotational movement and closing said support means;

rotating the turntable to bring the support means into vertical alignment with said first fixed station;

feeding materials from said conveying means into said weighing means until the accumulated amount reaches a predetermined weight;

transferring the accumulated materials to said dispensing means;

lowering the dispensing means so that a lower portion thereof is received in a neck of the container at the first fixed station;

dispensing the materials into the container and simultaneously confining dust;

stopping dust confinement and lifting off the dispensing means after the materials are dispensed into the container at said first fixed station;

rotating said turntable to bring the loaded support means into vertical alignment with the second fixed station;

lowering the vacuum means into sealing relation with the top of the support means;

operating said vacuum means to apply a vacuum to the space between the vacuum means and the top of the support means;

moving said sealing means towards the neck of the filled container and welding walls of the neck to seal the same;

venting the space to the surroundings;

lifting off the vacuum means;

rotating the turntable through an angle corresponding to an unloading position;

opening the support means and removing the sealed container from the support means; and rotating the turntable to bring the empty support means to a loading position.

24. A method according to claim 23, wherein said steps are carried out sequentially on successively loaded empty containers.

25. A method according to claim 23, wherein the step of loading the container into the support means and discharging the container from the support means are effected by inclining a pivoted portion of the support means to a desired angle.

26. A method according to claim 23, further comprising stopping the conveying means once a predetermined weight of material is accumulated in the weighing means independently of other steps.

27. A method according to claim 23, wherein the container loading and unloading steps are carried out at separate loading and unloading stations respectively upstream of the fixed first station and downstream of the second fixed station.

* * * * *